United States Patent [19]

Alfrey

[11] 3,955,058

[45] May 4, 1976

[54] RATCHET SWITCH

[75] Inventor: James L. Alfrey, Kokomo, Ind.

[73] Assignee: The Scott & Fetzer Company, Lakewood, Ohio

[22] Filed: Sept. 27, 1974

[21] Appl. No.: 509,842

[52] U.S. Cl. ..... 200/156; 200/64

[51] Int. Cl.[2] ..... H01H 17/08

[58] Field of Search ..... 200/156, 64, 63 A, 66, 200/116, 11 K, 283, 246, 153 J

[56] References Cited

UNITED STATES PATENTS

| | | | |
|---|---|---|---|
| 435,024 | 8/1890 | Rockwell | 200/156 X |
| 497,411 | 5/1893 | McGregory | 200/156 |
| 497,756 | 5/1893 | Woltmann et al. | 200/156 X |
| 500,199 | 6/1893 | George, Jr. | 200/64 |
| 1,160,620 | 11/1915 | Klein | 200/64 X |
| 1,345,899 | 7/1920 | Stevens et al. | 200/64 X |
| 1,512,594 | 10/1924 | Grady | 200/64 |
| 1,909,107 | 5/1933 | Kelly | 200/156 |
| 2,324,459 | 7/1943 | Popp et al. | 200/156 X |

*Primary Examiner*—Herman Hohauser
*Attorney, Agent, or Firm*—McNenny, Farrington, Pearne & Gordon

[57] ABSTRACT

A ratchet switch including a switch wheel formed from an insulating material and having a plurality of electrically connected contact plates spaced about its periphery. Contact arms are flexed and biased against the switch wheel for establishing a circuit across contacted plates and for breaking said circuit when the wheel is moved to a position wherein the contact arms contact insulating spaces between the plates. At least a portion of each of the arms comprises a cantilever beam fixed at one end and free at the other and curving away from its contact plate from a line of tangency established between the plate and the beam, with any remaining portion of each arm lying in substantially parallel relationship with each plate. According to a preferred aspect of the invention, the line of tangency is closer to the edge of the plate adjacent the fixed end of the beam than to the edge of the plate adjacent the free end of the arm.

8 Claims, 4 Drawing Figures

RATCHET SWITCH

BACKGROUND OF THE INVENTION

This invention relates to ratchet switches and, more particularly, to switches which will alternately make and break a circuit upon actuation of a pawl. Switches of this type are widely used as foot switches on commercial and domestic vacuum cleaners. One such widely used ratchet switch includes a pawldriven ratchet wheel and a switch wheel driven by the ratchet wheel. The switch wheel is provided with a plurality of electrically connected contact plates spaced about the periphery of the wheel and separated circumferentially by an insulating material. Contact arms are biased against the periphery of the switch wheel to alternately make and break a circuit as the switch wheel is driven by the ratchet wheel. The ends of the contact arms contact the plates and the arm has a preshaped or unstressed curvature which concavely faces the contact plate. Each time the blade wipes across a plate, some metal is lost from its tip, due to frictional wear and due to arcing between the plate and the arm. The tip, therefore, is worn away in a direction of increasing clearance between the arm and the plate, resulting in an increasing loss of arm deflection. As arm deflection is lost, contact pressure decreases with a resulting increase in arm and contact plate operating temperatures as the switch is cycled. Underwriters' Laboratories requires that a switch maintain a temperature less than 30° C. over ambient temperature. It has been determined, however, that the previously described prior art switch will rise above the 30° C. limitation in less than 15,000 cycles.

As the prior art arms shorten, they reach a length in which there is substantially no contact pressure between the arm and its plate, so that as the arm snaps toward the plate, it will momentarily touch the contact and then release. This causes the vacuum cleaner or other associated appliance to be momentarily pulsed, with attendant degradation of the motor and substantial arcing.

Furthermore, since the arms act as an escapement mechanism on the ratchet wheel, tending to bias the wheel in a proper position against the pawl, a substantially even wear on both arms will result in the switch wheel's changing its predetermined rotative position with respect to the arms. As the contact pressure is decreased moreover, the pawl and ratchet mechanism becomes less and less positive.

SUMMARY OF THE INVENTION

This invention overcomes many of the foregoing prior art problems by providing a ratchet switch having arms that maintain their original contact pressure throughout many thousand cycles, even though the contact arms may be progressively worn at their ends. According to the invention, a ratchet switch is provided which includes a switch wheel formed from an insulating material and having a plurality of electrically connected contact plates spaced about its periphery. Contact arms which are straight in an unstressed or relaxed condition are flexed and biased against the switch wheel for establishing a circuit across contacted plates and for breaking the circuit when the wheel is moved to a position wherein the contact arms contact insulating spaces between the plates. The switch wheel is moved in a step-by-step fashion by a pawl and ratchet wheel arrangement drivingly associated with the switch wheel. At least a portion of each of the arms comprises a cantilever beam fixed at one end and free at the other and curving away from its contact plate from a line of tangency established between the plate and the beam, with any remaining portion of each arm lying in substantially parallel relationship with each plate. The cantilever portion of the switch arm, therefore, presents a convex face to the plate and diverges away from the plate in an extremely gradual fashion. Thus, the remaining portion of each arm may be considered as extra material which may be worm away so that, although the remaining portion of each arm decreases toward the line of tangency, the predetermined contact pressure between that line of tangency and the plate is maintained throughout many thousand cycles of operation.

Even after the arm is worn past the original line of tangency, substantially no contact pressure is lost, since the beam curves gradually away from the plate and the new lines of tangency that are established as the end of the beam wears do not require significant straightening of the beam. Thus, even when the line of tangency reaches the extreme end of the plate, the switch will perform without significant loss of contact pressure. In view of all of the foregoing, it is desirable to provide the line of tangency closer to the edge of the plate adjacent the fixed end of the beam so that the remaining portion of the arm serves as a reservoir of extra material which may be worn away without any effect on the operating characteristics of the beam.

According to a further aspect of this invention, a pair of switch arms are provided, and one of the arms has its fixed end positioned further away from the wheel or one arm may be made slightly shorter than the other. Both arms tend to bias the wheel in the direction opposite the direction of pawl-induced movement. The closer or longer arm serves as a "no-back" throughout the life of the switch, since that arm will have little or no arcing. Thus, during operation of the switch, the shorter blade will leave its plate first and, although it will be subjected to considerable arcing and wear, the predetermined rotative position of the switch wheel will not change throughout the life of the switch. Obviously, if both switch arms were subjected to the same degree of wear, the switch wheel would be biased backwards to a greater degree and the predetermined point of tangency would change and the angle of departure between the switch arm and the plate would be increased.

Switches designed according to the present invention exhibit a heat rise of about 11° C. above ambient after over 75,000 cycles, as compared to the previously described prior art switch, which exhibits a heat rise of 30° C. above ambient in less than 15,000 cycles.

DETAILED DESCRIPTION OF THE DRAWING

Figure 1:
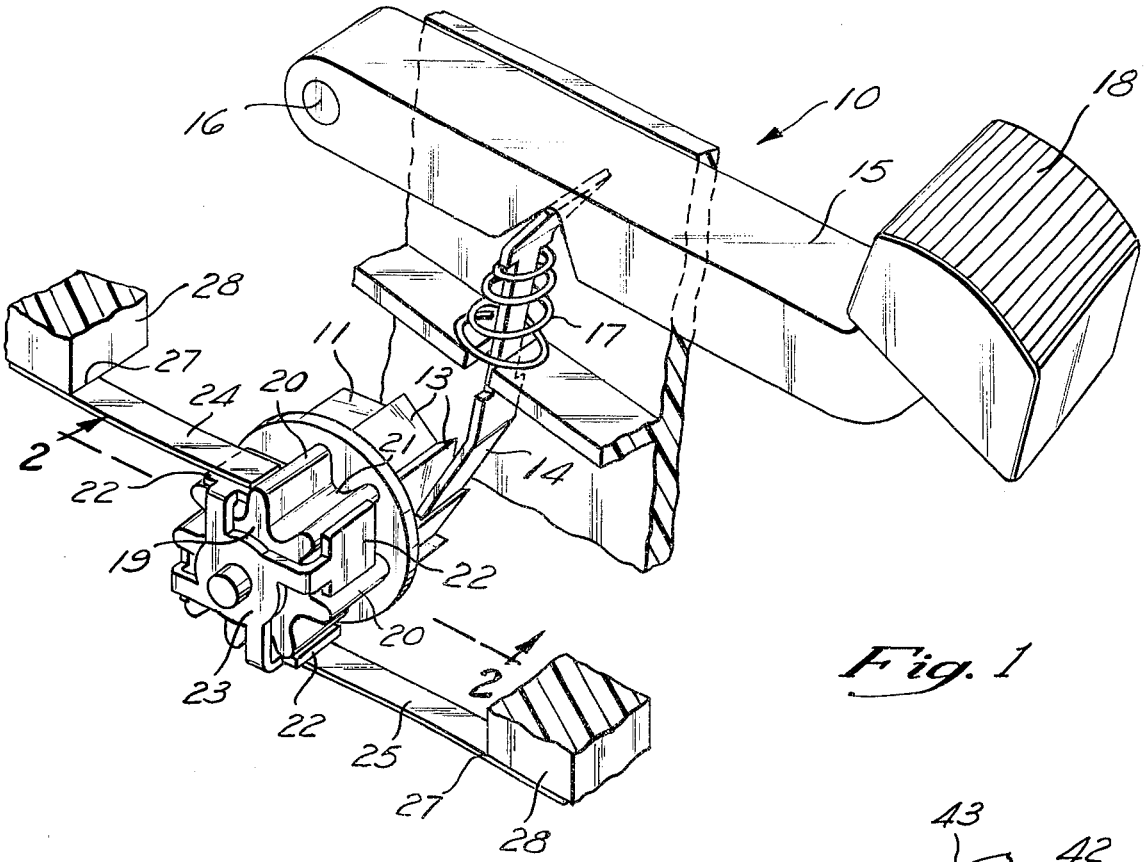
FIG. 1 is a fragmentary, perspective view of a ratchet switch in accordance with this invention.

Referring now to the drawing, and more particularly to FIG. 1 thereof, there is illustrated a ratchet switch 10 according to the invention. The switch 10 includes a ratchet wheel 11 rotatably mounted within a housing 12 and having a plurality of ratchet teeth 13 sequentially engaged by a pawl 14. The pawl 14 is, in turn, sequentially operated by a lever arm 15 pivoted at one end to a pin 16. The lever arm 15 works against a compression spring 17 surrounding the upper end of the pawl. The free end of the lever arm 15 is provided with an actuating pad 18 and the switch 10 may therefore be a foot-operated switch having the pad 18 extending from the motor casing of a vacuum cleaner.

The ratchet wheel 11 is integral with, and therefore drives, a rotatable switch wheel 19. The switch wheel 19 is made from a nonconducting insulating material such as a suitable plastic and has a plurality of radially extending projections 20 separated by valleys 21. A plurality of contact plates 22 are interposed in alternate valleys 21 so as to extend from the top of one projection 20 to a position abutting the side of an adjacent projection 20. The plates 22 are made from a conducting material such as copper and are all electrically connected by a web structure 23.

There is also provided a plurality of contact arms 24 and 25, and those arms are respectively flexed and biased against a plate 22 to establish a circuit across the contact plates. As the ratchet wheel 11 is driven in a step-by-step fashion by the pawl 14, the contact arms alternately engage electrically connected plates and the insulating material in the valleys 21 between the projections 20. Thus, when the contact arms are in the solid outline position, the plates are contacted; when the arms are in the position indicated as 24*a* and 25*a*, the arms are in the valleys between the projection to thereby break the circuit; and when the arms are in the position illustrated as 24*b* and 25*b*, the contact arms are just riding over the edge of a plate.

At least a portion of each of the arms comprises a cantilever beam fixed at one end, free at the other, and curving away from its contact plate from a line of tangency established between the plate and the arc of the beam. The beams present a convex face to the plates. The cantilever portion of the beam, therefore, extends from a line of tangency 26 to a line 27 wherein the beam is fixed to a support 28. Electrical connections (not shown) are provided between the fixed ends of the beams and other circuitry. Any remaining portion of the arms, such as the portions between the lines of tangency 26 and the ends 29 and 30 of the arms, lies in substantially parallel relationship with each plate 22. These remaining portions, while not constituting part of the cantilever beams, provide an advantageous aspect of the present invention, as will now be explained.

As the switch 10 is repeatedly cycled, a switch arm end such as the end 29 is worn away by mechanical abrasion, and particularly by arcing, as the end snaps from a contact plate 22. Thus, the distance between the line of tangency and the end of the switch arms becomes less and less, but the line of tangency does not change its position relative to a plate 22. Therefore, contact pressure between the arms and the plate at the line of tangency is maintained throughout a great number of cycles. When the end 29 has worn to the extent that it itself becomes the line of tangency between the cantilever beam and a plate 22, and therefore begins to move the line of tangency toward the fixed end of the beam, no substantial contact pressure is lost because of the very slight degree of divergence as the beam leaves the point of tangency. Ultimately, the end 29 will no longer be able to contact the surface of a plate 22 and the switch will desirably fail both mechanically and electrically. Therefore, according to one aspect of this invention, it is desirable to locate a line of tangency 26 closer to the edge of the plate adjacent the fixed end of the beam than to the edge of the plate adjacent the free end of the arm.

Figure 2:
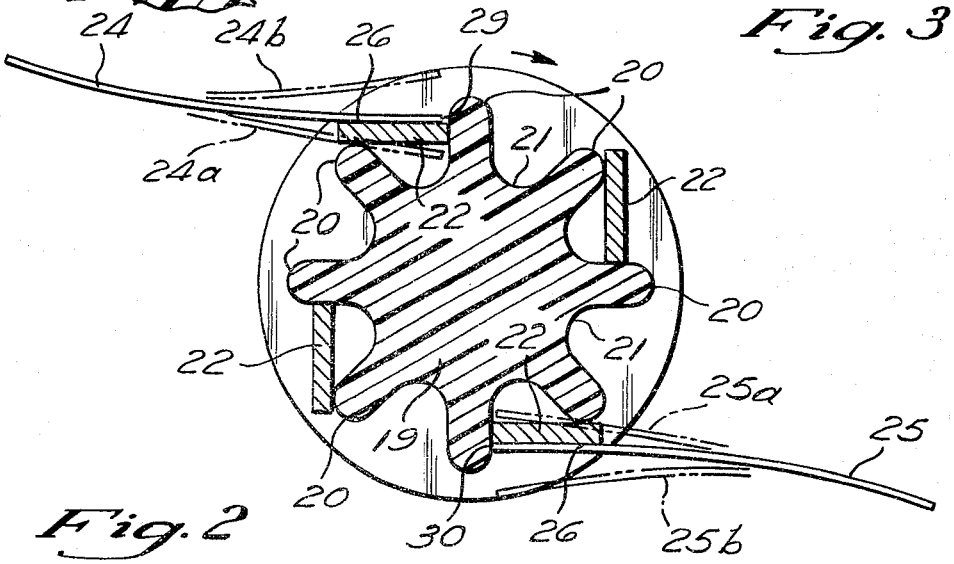
FIG. 2 is a cross sectional view, the plane of the section being indicated by the line 2—2 in FIG. 1.

According to a further aspect of this invention, it is desirable to make one of the arms longer than the other, or have the arms of uniform length with the fixed end of one arm positioned further away from the wheel so that one arm will serve to maintain the switch wheel in its predetermined illustrated position while the other arm will wear away at a more rapid rate. As is illustrated in FIG. 2, the arm 25 is longer than the arm 24 and butts against a projection 20, while the arm 24 is slightly spaced from a projection 20. In operation, the arm 24 will leave its plate 22 just before the arm 25 leaves its plate. Therefore, little or no arcing will occur between the arm 25 and its plate, while arcing will occur between the arm 24 and its plate. Therefore, the arm 24 will wear, but the arm 25 will substantially maintain its length to minimize reverse rotation of the switch wheel out of its predetermined position.

Figure 3:
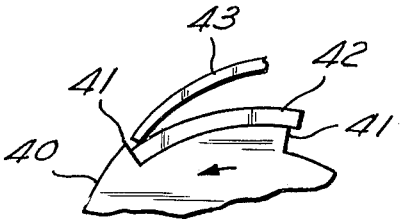
(PRIOR ART) Fig. 3
FIG. 3 is a fragmentary, elevational view of a prior art ratchet switch illustrating a contact arm and a contact plate.

Referring now to FIG. 3, there is illustrated a prior art ratchet switch. The prior art ratchet switch includes a ratchet wheel 40 made from an insulating material and having a plurality of projections 41 spaced about its periphery. Positioned between alternate pairs of projections 41 is a plurality of conducting plates, such as the conducting plate 42. A pair of contact arms, such as the contact arm 43, is biased against the switch wheel 40 to alternately contact a plate 42 and an insulating space between the plates. Each switch arm 43 is precurved to present a concave face to the plate 42.

Since the arm 43 presents a concave face to the plate 42, it rapidly curves away from the plate 42, resulting in contact pressure that is rapidly lost as the end of the arm wears. Furthermore, when the end of the arm 43 is worn so that it no longer makes biasing contact with the plate, it may snap into momentary contact with the plate as it slides off the adjacent projection 41. This will create an undesirable arcing situation and momentarily pulse the motor.

Figure 4:
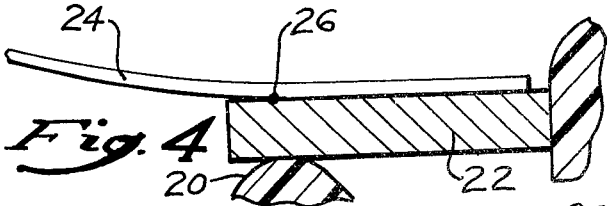
FIG. 4 is an enlarged, fragmentary, cross sectional view of the contact arm showing the line of tangency between the arm and plate.

Referring now to FIG. 4, it may be noted that the contact arm 24 is biased against its contact plate. In this view, the arc formed by the biased arm 24 meets the contact plate at a fixed line of tangency 26. This fixed line of tangency is desirably located closer to the edge of the contact plate adjacent the fixed end of the cantilever beam. The portion of the arm from the line of tangency 26 to the free end of the arm represents the reservoir of extra material to be worn away.

The invention is not restricted to the slavish imitation of each and every detail set forth above. Obviously, devices may be provided which change, eliminate, or add certain specific details without departing from the scope of the invention.

What is claimed is:

1. A ratchet switch comprising a ratchet wheel rotatably mounted within a housing, pawl means within said housing for driving said ratchet wheel in a first direction, a rotatable switch wheel driven by said ratchet wheel, said switch wheel comprising a wheel formed from an insulating material and having a plurality of electrically connected contact plates spaced about its periphery, contact arms flexed and biased against said switch wheel for establishing a circuit across contacted plates and for breaking said circuit when said wheel is moved to a position wherein the contact arms contact insulating spaces between said plates, at least a portion of each of said arms comprising a cantilever beam fixed at one end, free at the other, and curving away from its contact plate from a line of tangency established between the plate and the beam, any remaining portion of each arm lying in substantially parallel relationship with each plate, said line of tangency being closer to the edge of the plate adjacent the fixed end of the beam than to the edge of the plate adjacent the free end of the arm.

2. a ratchet switch according to claim 1, wherein a pair of contact arms is provided and wherein one of said arms is shorter than the other.

3. A ratchet switch according to claim 2, wherein said switch wheel has a plurality of radially extending projections, wherein said contact plates are interposed in alternate valleys between said projections, wherein said arms provide a force couple on said switch wheel to bias said wheel in a second direction, and wherein the end of the longer of said arms butts against a projection.

4. A ratchet switch according to claim 1, wherein a pair of contact arms is provided, wherein said switch wheel has a plurality of radially extending projections, wherein said contact plates are interposed in alternate valleys between said projections, wherein said arms provide a force couple on said switch wheel to bias said wheel in a second direction, and wherein the end of only one of said arms butts against a projection.

5. A ratchet switch comprising a switch wheel formed from an insulating material and having a plurality of electrically connected contact plates spaced about its periphery, contact arms flexed and biased against said switch wheel for establishing a circuit across contacted plates and for breaking said circuit when said wheel is moved to a position wherein the contact arms contact insulating spaces between said plates, at least a portion of each of said arms comprising a cantilever beam fixed at one end and free at the other and curving away from its contact plate from a line tangency established between the plate and the beam, any remaining portion of each arm lying in substantially parallel relationship with each plate, said line of tangency being closer to the edge of the plate adjacent the fixed end of the beam than to the edge of the plate adjacent the free end of the arm.

6. A ratchet switch according to claim 5, wherein a pair of contact arms is provided and wherein one of said arms is shorter than the other.

7. A ratchet switch according to claim 6, wherein said switch wheel has a plurality of radially extending projections, wherein said contact plates are interposed in alternate valleys between said projections, wherein said arms provide a force couple on said switch wheel to bias said wheel in a second direction, and wherein the end of the longer of said arms butts against a projection.

8. A ratchet switch according to claim 5, wherein a pair of contact arms is provided, wherein said switch wheel has a plurality of radially extending projections, wherein said contact plates are interposed in alternate valleys between said projections, wherein said arms provide a force couple on said switch wheel to bias said wheel in a second direction, and wherein the end of only one of said arms butts against a projection.

* * * * *